US008517286B2

(12) United States Patent
Jung

(10) Patent No.: US 8,517,286 B2
(45) Date of Patent: Aug. 27, 2013

(54) SPRINKLER HEAD PROTECTOR

(76) Inventor: Man-Young Jung, Pasadena, CA (US)

( * ) Notice: Subject to any disclaimer, the term of this patent is extended or adjusted under 35 U.S.C. 154(b) by 212 days.

(21) Appl. No.: 13/109,542

(22) Filed: May 17, 2011

(65) Prior Publication Data

US 2012/0292404 A1 Nov. 22, 2012

(51) Int. Cl.
*B05B 1/28* (2006.01)

(52) U.S. Cl.
USPC ..... 239/288.5; 239/288.3

(58) Field of Classification Search
USPC ..... 239/288, 288.3, 288.5, 200–202, 239/600; 248/85, 87
See application file for complete search history.

(56) References Cited

U.S. PATENT DOCUMENTS

| | | | | |
|---|---|---|---|---|
| 2,751,250 | A * | 6/1956 | Block | 239/201 |
| 3,193,205 | A * | 7/1965 | Hanson | 239/276 |
| 3,830,434 | A * | 8/1974 | Green et al. | 239/562 |
| 5,037,030 | A * | 8/1991 | Apodaca | 239/288 |
| 5,931,385 | A * | 8/1999 | Miller | 239/288 |
| 2001/0032890 | A1 * | 10/2001 | Stephens | 239/200 |
| 2005/0279857 | A1 * | 12/2005 | Quach | 239/201 |

* cited by examiner

*Primary Examiner* — Davis Hwu
(74) *Attorney, Agent, or Firm* — Clement Cheng

(57) ABSTRACT

The sprinkler head protector can fit over sprinkler heads of automatic sprinkler systems. A sprinkler head protector includes a shell having a top opening, and the top opening is disposed with a top side wall to which it is joined. A shoulder has a concave facing downward, and the shoulder is formed to be flat. Prongs extend downward from the shoulder, and the prongs each have a pair of laterally extending edges. The prongs have a planar shape. Root openings are disposed on the surface of the prongs. Tips are formed at each of the prongs. The prongs may have elongated root openings or round root openings to receive anchoring connection with roots of plants.

8 Claims, 2 Drawing Sheets

SPRINKLER HEAD PROTECTOR

FIELD OF THE INVENTION

The present invention is in the field of sprinkler head protectors.

DISCUSSION OF RELATED ART

Automatic sprinkler systems are becoming more and more widespread. The systems save water by directing it exactly where it is needed and at the time of day when evaporative losses can be minimized, and save labor by eliminating the need to move hoses. Such systems, however tend to have high parts count, including many parts which are vulnerable to damage from lawn mowing machinery, overgrown grass, and other hazards. When automatic sprinkler systems break down, the entire labor savings may be lost, due to the time and cost of repairing the system.

Since 1960's, there have been numerous inventions that sought to fix the issue of damaged sprinkler heads. Issued on August 1966, Felix Cohen patented one of the first sprinkler head protectors. U.S. Pat. No. 3,265,310 sought to provide a sprinkler head protector which was simple in construction, durable, easy to install and allows working access to the sprinkler head. Ten years later U.S. Pat. No. 3,904,120 Sprinkler Head Stabilizer and Protector brought even greater promises by proposing the construction of thick, large diameter ring molded from pliant plastic composition. These protectors were not subject to degradation by ultraviolet light, high summer temperatures, and sub-zero winter temperatures.

Although sprinkler head protectors are designed for a single purpose, there have been many variations in these inventions. For example, U.S. patent application Ser. No. 10/858,316 Sprinkler Head Guard, issued on Jun. 30, 1998, comprises a triangle, square rectangle, trapezoid, or other shaped body of a depth sufficient to be embedded into the ground. The body also included a passage through which the sprinkler head of the in-ground sprinkler irrigation system may pass. Others such as U.S. Pat. No. 5,918,814 issued on Jul. 6, 1999 offer different designs of sprinkler head protectors. The sprinkler head protector in this patent consisted of five embodiments that provide an annular body defining a central hole and having a variety of differently designed spikes for retaining the body in place about a sprinkler head.

Some sprinkler head protectors have also attempted to overcome deficiencies of the prior art. U.S. Pat. No. 5,039,015 issued on Aug. 13, 1991 provided a temporary shield structure to permit access to a working sprinkler head. This sprinkler head "shield" provided a new and improved shield apparatus wherein the same provided a portable plate member selectively positioned all about a sprinkler head to provide temporary deflection of water spray from the sprinkler head to provide ease of access to the sprinkler head for maintenance and adjustment thereof.

SUMMARY OF THE INVENTION

The sprinkler head protector can fit over sprinkler heads of automatic sprinkler systems. A sprinkler head protector includes a shell having a top opening, and the top opening is disposed with a top side wall to which it is joined. A shoulder has a concave facing downward, and the shoulder is formed to be flat. Prongs extend downward from the shoulder, and the prongs each have a pair of laterally extending edges. The prongs have a planar shape. Root openings are disposed on the surface of the prongs. Tips are formed at each of the prongs.

The prongs may have elongated root openings or round root openings to receive anchoring connection with roots of plants. A second shell portion can be connected to the shell. A threaded connection can be formed between the second shell portion and the shell. A threaded connection can be formed between the second shell portion and the shell and further comprising elongated root openings.

A threaded connection can be formed between the second shell portion and the shell and the prongs may also have round root openings for anchoring. The shell receives the second shell portion within the shell, and the second shell portion is nested within the shell. Round root openings can be generally circular or oval shaped. Elongated root openings can be formed as slots or elongated ellipses. Preferably, the top side wall protrudes upwardly vertically from a periphery of the top opening, and the shoulder has an upper portion where the shoulder extends outwardly in a generally horizontal manner and then tapers down toward prongs so that the prongs are pointed.

Figure 2:
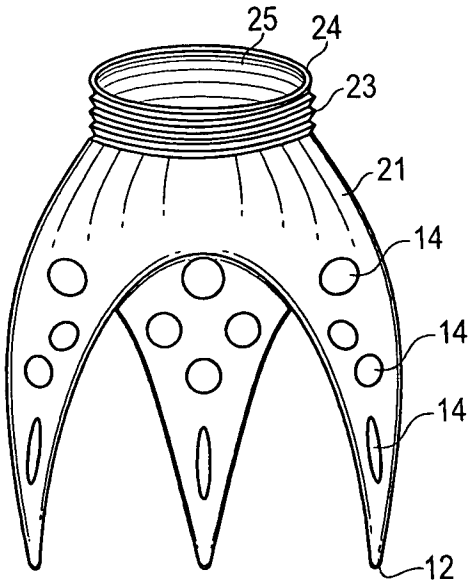
FIG. 2 is a perspective view of the speaker head inner portion.
Figure 1:
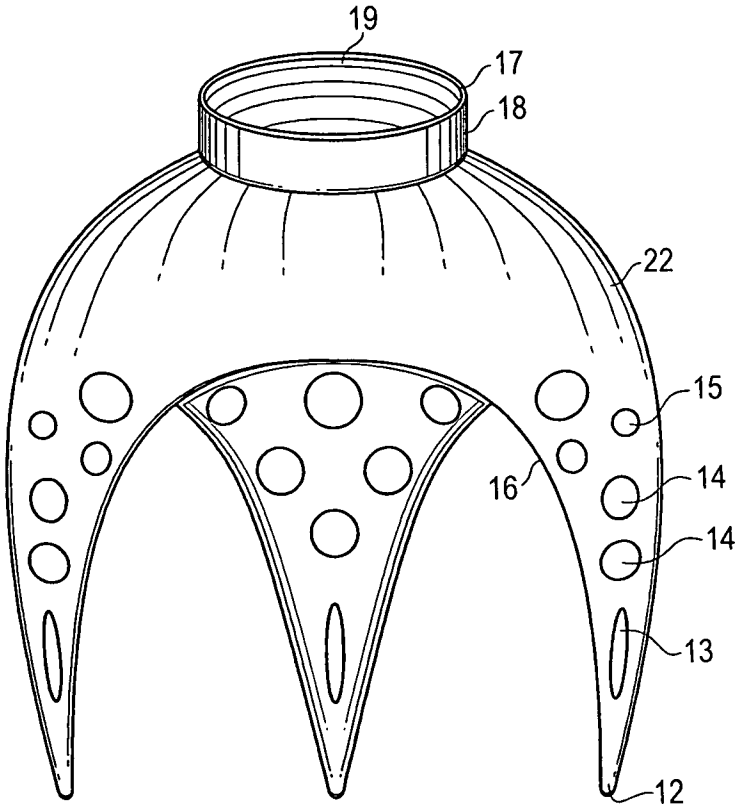
FIG. 1 is a perspective view of the sprinkler head protector outer portion.
Figure 3:
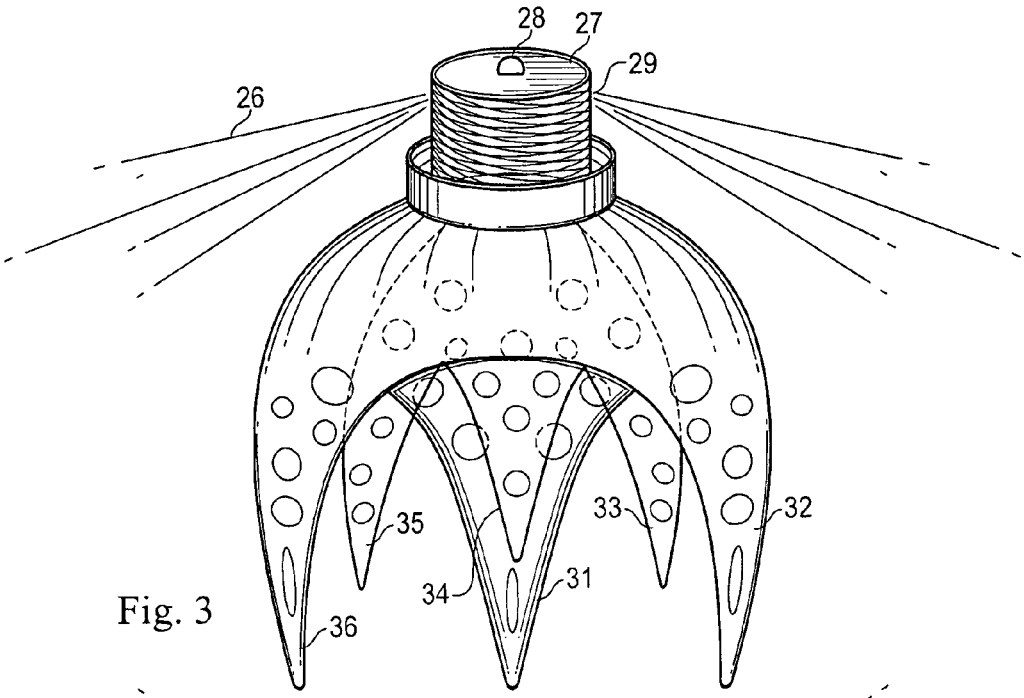
FIG. 3 is an assembled view of the outer portion connected to the inner portion.
Figure 4:
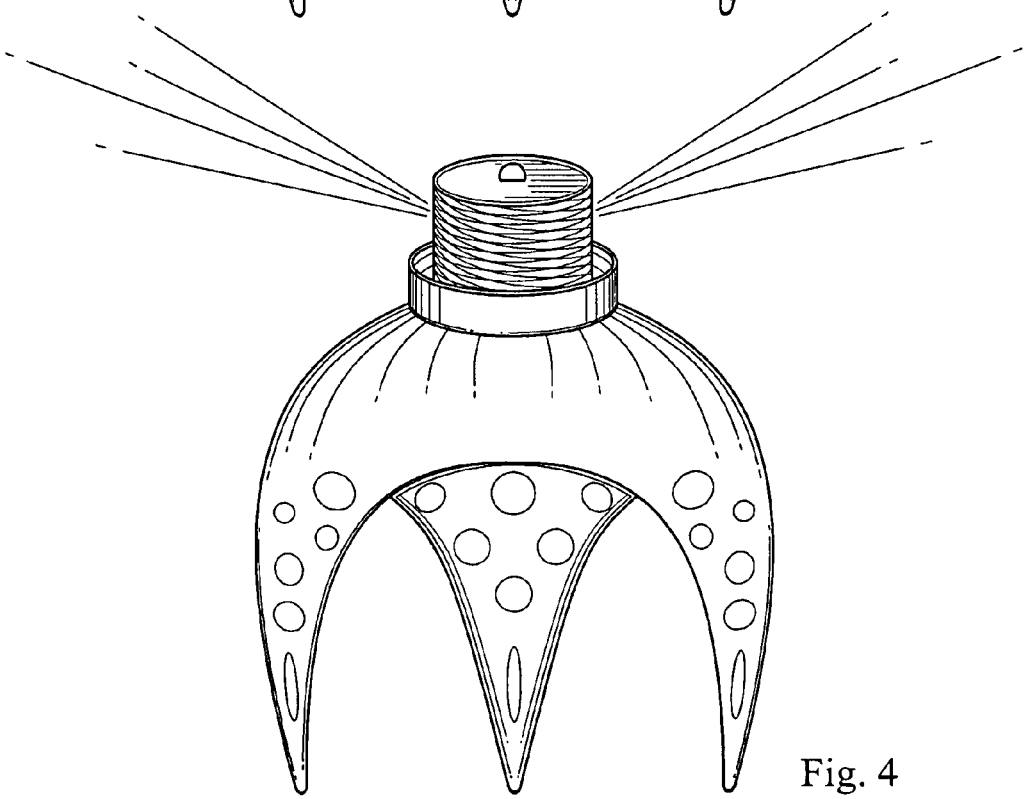
FIG. 4 is a perspective view of the sprinkler head protector outer portion alone.

The following call out list of elements can be a useful guide in referencing the claims of the drawings.

12 Prong Tip
13 Large Elongated Root Opening
14 Large Root Opening
15 Small Root Opening
16 Prong Edge
17 Outer Portion Rim
18 Outer Portion Top Wall
19 Outer Portion Internal Thread
21 Inner Portion Shoulder
22 Outer Portion Shoulder
23 Inner Portion External Thread
24 Inner Portion Rim
25 Inner Portion Internal Thread
26 Water
27 Sprinkler Head Top
28 Sprinkler Head Adjustment
29 Sprinkler Head Side
31 First Prong
32 Second Prong
33 Third Prong
34 Fourth Prong
35 Fifth Prong
36 Sixth Prong

DETAILED DESCRIPTION OF THE PREFERRED EMBODIMENT

A sprinkler head protector can be made of plastic or metal in one or two sections. A plastic injection molded or stamped and drawn metal sheet can be formed into an outer portion and an inner portion. The outer portion and inner portion have a bottom concave and a plurality of prongs extending downward from a rim. There can be a total of three prongs for each section. Optionally, the outer portion can be merged to the inner portion such as by threaded attachment.

Each of the prongs has a prong tip 12. The prongs are formed as planar members and have a large elongated root openings 13 disposed through the outside surface of the prongs. Large root openings 14 and small root openings 15 are also disposed through the prong to allow roots to grow through and anchor the sprinkler head protector to the ground. The prongs being planar members have a prong edge 16 disposed on a left and right side of the prong.

The outer portion rim 17 can be a circular top edge of a cylindrical portion of the sprinkler head protector. The outer portion top wall 18 can be formed on a side wall of the cylindrical portion of the sprinkler head protector. The outer portion has an outer portion internal thread 19. The outer portion internal thread 19 is formed to connect with an inner portion external thread 23 so that the outer portion can be screwed together with the inner portion. The inner portion shoulder 21 matches with the outer portion shoulder 22 so that an offset gap is defined between the inner portion shoulder 21 and the outer portion shoulder 22. The inner portion external thread 23 is disposed on an exterior surface of the inner portion and the outer portion internal thread is disposed on an internal surface of the outer portion.

The inner portion rim also defines an upper edge of a cylindrical surface which is attached to the inner portion shoulder 21. The outer portion top wall extends from an upper surface of the outer portion shoulder 22. The inner portion top wall extends from the upper surface of the inner portion shoulder 21. The inner portion rim 24 is defined at the top edge of the inner portion top wall. The inner portion internal thread 25 optionally allows connection to a third portion smaller than the inner portion and scaled down from the inner portion in size in the same manner that the inner portion is scaled down in size from the outer portion.

During use, the outer portion and optionally the inner portion can be installed in the ground to stabilize flow of water 26 from a sprinkler head top 27. The sprinkler head typically also includes a sprinkler head adjustment 28 which allows adjustment of the sprinkler head. The sprinkler typically also includes a side which defines a smaller circumference than the inner portion rim 24 and a smaller circumference than the outer portion rim.

Elongated openings can be elongated in a vertical direction. Round openings are preferably disposed on an upper portion of prongs, and elongated openings are preferably disposed at a lower portion of prongs. Prongs define a surface to receive elongated and a round openings.

When both the inner portion and outer portion is connected, the inner portion may have three prongs and the outer portion may have three prongs. The sprinkler head protector can therefore be comprised of a first prong 31, a second prong 32, a third prong 33, a fourth prong 34, a fifth prong 35, and sixth prong 36.

The invention claimed is:

1. A sprinkler head protector comprising:

a. a shell having a top opening, wherein the top opening is disposed with a top side wall;

b. a shoulder having a concave facing downward, wherein the shoulder is formed to be flat;

c. prongs extending downward from the shoulder, wherein the prongs each have a pair of laterally extending edges and, wherein the prongs have a planar shape;

d. root openings disposed on the surface of the prongs;

e. a tips formed at each of the prongs, further comprising a second shell portion connected to the shell, further comprising a threaded connection between the second shell portion and the shell, wherein the shell receives the second shell portion within the shell, wherein the second shell portion is nested within the shell, wherein the top side wall protrudes upwardly vertically from a periphery of the top opening, wherein the shoulder has an upper portion where the shoulder extends outwardly in a generally horizontal manner and then tapers down toward prongs, wherein the prongs are pointed.

2. The sprinkler head protector of claim 1, further comprising elongated root openings.

3. The sprinkler head protector of claim 1, further comprising round root openings.

4. The sprinkler head protector of claim 1, further comprising a second shell portion connected to the shell.

5. The sprinkler head protector of claim 4, further comprising a threaded connection between the second shell portion and the shell.

6. The sprinkler head protector of claim 5, further comprising a threaded connection between the second shell portion and the shell and further comprising elongated root openings.

7. The sprinkler head protector of claim 6, further comprising a threaded connection between the second shell portion and the shell and further comprising round root openings.

8. The sprinkler head protector of claim 6, wherein the shell receives the second shell portion within the shell, wherein the second shell portion is nested within the shell.

* * * * *